United States Patent [19]

Etheredge

[11] Patent Number: 4,795,194

[45] Date of Patent: Jan. 3, 1989

[54] COVER AND JACKET WITH POCKET AND METHOD OF MANUFACTURE THEREOF

[76] Inventor: Nancy Etheredge, 145 E. 16th St., New York, N.Y. 10003

[21] Appl. No.: 52,456

[22] Filed: May 20, 1987

[51] Int. Cl.[4] ..... B42D 3/04; B42D 3/00; B41L 1/20

[52] U.S. Cl. ..... 281/34; 281/31; 282/11.5 R

[58] Field of Search ..... 281/15 R, 31, 34, 38, 281/40, 45, 46; 40/159, 537; 282/11.5 R

[56] References Cited

U.S. PATENT DOCUMENTS

| | | | |
|---|---|---|---|
| 1,957,926 | 5/1934 | Williamson | 281/34 |
| 2,523,129 | 9/1950 | Maier | 281/31 |
| 2,641,484 | 6/1953 | Brody | 281/34 |
| 3,021,156 | 2/1962 | Coillot | 281/31 |
| 3,915,778 | 10/1975 | Carter et al. | 281/31 |
| 4,519,630 | 5/1985 | Holmes | 281/34 |
| 4,527,814 | 7/1985 | Carter et al. | 281/34 |

*Primary Examiner*—E. R. Kazenske
*Assistant Examiner*—Paul M. Heyrana, Sr.
*Attorney, Agent, or Firm*—McAulay, Fields, Fisher, Goldstein & Nissen

[57] ABSTRACT

A cover jacket for a book or equivalent, having a jacket member with a front member to form a front piece for the book cover and a rear member to form a back piece for the book cover, the front and rear members being joined to each other and a pocket on the jacket member joined thereto. The cover jacket is manufactured by providing a first sheet of material to form a cover for the book, then placing a second sheet of material onto the front piece area of the first sheet overlying thereof, and then sealing the second sheet of material to the first sheet of material to form a pocket between the first and second sheets.

12 Claims, 1 Drawing Sheet

COVER AND JACKET WITH POCKET AND METHOD OF MANUFACTURE THEREOF

BACKGROUND OF THE INVENTION

1. Field of the Invention

This invention relates to a cover and a jacket with a pocket for a book and a method of manufacture thereof.

More particularly, the present invention is concerned with a cover and a jacket which, in addition to protecting the book and providing for the usual conventional written material, also provides for a visual impression formed by means other than solely printing. Such visual impression means is achieved with a pocket and material to be inserted thereinto.

2. Description of the Prior Art

Heretofore, book jackets have generally been opaque, although there have been translucent and transparent jackets used.

A jacket is considered to be a removable article which is generally used with hard cover books but which can be used with a paperback. On the other hand, a cover is generally formed as an integral unit with the binding of a book and is not generally considered to be a removable object.

As is well known, jackets were normally formed of paper, and sometimes of strong paper, in order to provide a picturesque view on the outer portion with information concerning the book as well as the author and background of the same. Jackets and covers were generally used both for information and protective reasons to avoid marring and scarring of the material from which a permanent book cover was made or of the pages forming a paperback book.

A primary purpose of the jacket and book cover is to attract an individual to the book so that a purchase will be made. For this purpose, artistic descriptions and drawings have been placed onto jackets and book covers in addition to the background and other advertising information which a seller thought would be helpful to attract a customer and sell the book.

SUMMARY OF THE INVENTION

The present invention proposes to provide for a cover and a jacket for a book or equivalent which has all of the aforesaid purposes, as well as to provide for a further dimension to attract an individual towards the book. More specifically, the present invention proposes to use a jacket formed of an individual jacket member made from transparent or translucent see-through PVC (polyvinyl chloride), acetate or an acetate-vinyl material. In addition, the portion which would normally cover or be placed onto the front cover of a hard cover book or form the cover of a paperback type book, in accordance with the teachings of the invention, is provided with a pocket. Such pocket can be used to insert different materials to attract the attention of a prospective purchaser or individual.

With the use of a pocket as taught in accordance with the present invention, it is possible to have a three-dimensional object or an object having some thickness or some breadth above a flat plane projection, which object is inserted into the pocket to provide a very unique overall visual effect which is different from the normal visual effect presently provided by a flat plane projection having a picture and/or writing or both thereon. It is within the scope of the present invention to provide the pocket so that materials related to or connected with the book or publication can be inserted into the pocket.

As a further feature of the invention, it is also possible with the invention to use a flat plane projection material which is inserted into the pocket. Such flat plane projection material can be varied in accordance with the community, area or country to which the book is being sent for sale. It is well known that while the United States, Great Britain and Canada all speak what is designated as the English language, there are certain terms which are different from each other in meaning in the three countries, and it is possible with the use of such pocket to have different flat plane projection materials inserted into the cover in order to attract individual purchasers in the three different countries. Moreover, it is well known that areas in different parts of different countries also have variations, and such materials can be inserted into such a pocket, which would be unique to the particular area.

As mentioned heretofore, it is possible to use a three-dimentional object in such pocket, and for example, if the book concerned snow or skiing or something of that nature, a three-dimensional object could be placed into the book pocket which would have a very unique overall visual aspect and attract individuals to the book.

In accordance with the present invention, it is proposed to provide for a cover or jacket for a book or equivalent, hereinafter referred to as a cover jacket, which includes a jacket member generally formed of a front member which would go on to or form the front cover of the book and a rear member which would cover or form the rear cover of the book together with a center portion overlying or forming the rear binding portion. In addition, a flap member would be connected to the front and rear members of a cover jacket for a hard cover book for folding into the book between the hard cover and the pages therebetween. When the cover jacket is used for a paperback type of book, it could also be used as an outer cover, but it is also desireably used to form an integral unit with the book and be the outer covering material to protect the pages.

Now, with respect to the front member, this would be formed with a pocket with another translucent or transparent member placed over the front member and heat-sealed on at least three of the sides. The fourth side would be open at one point in time so that material can be inserted into the pocket and then the pocket sealed. The pocket could be sealed by means of heat sealing or by means of a suitable tape, so that the front portion would have a pocket with a two and preferably a three-dimensional item inside. It is also within the scope of the invention to form on the pocket member or the rear member as well as the back portion on the spine of the book connecting the front and rear members.

Two-dimensional item is intended herein to cover those objects which have a negligible thickness with respect to the width or length, or to an object in which the thickness is not an essential element of the impression that the object is intended to convey.

To these ends, the invention also consists in the provision of a method for manufacturing a book cover jacket with a pocket for a book, comprising providing a first sheet of material to form a cover for a book, the first sheet having a front piece area, a rear piece area and a spine area joining the front piece area and the rear piece area, and a flap for the front piece and the rear piece; placing a second sheet of material onto the front piece area overlying thereof; and sealing the second sheet to the first sheet of material.

The method also includes the process for the manufacture of the two embodiments. One embodiment is the heat sealing of all sides to the cover, and the other embodiment is a combination of heat sealing and taping the sides of the outer pocket member to the cover.

The method also contemplates the manufacture of a cover jacket when used as a separate cover and removable from the book cover and as an integral unit with the pages of the book to form the outer cover.

Figures 1, 2, 3, 4, 5, 6, 7:
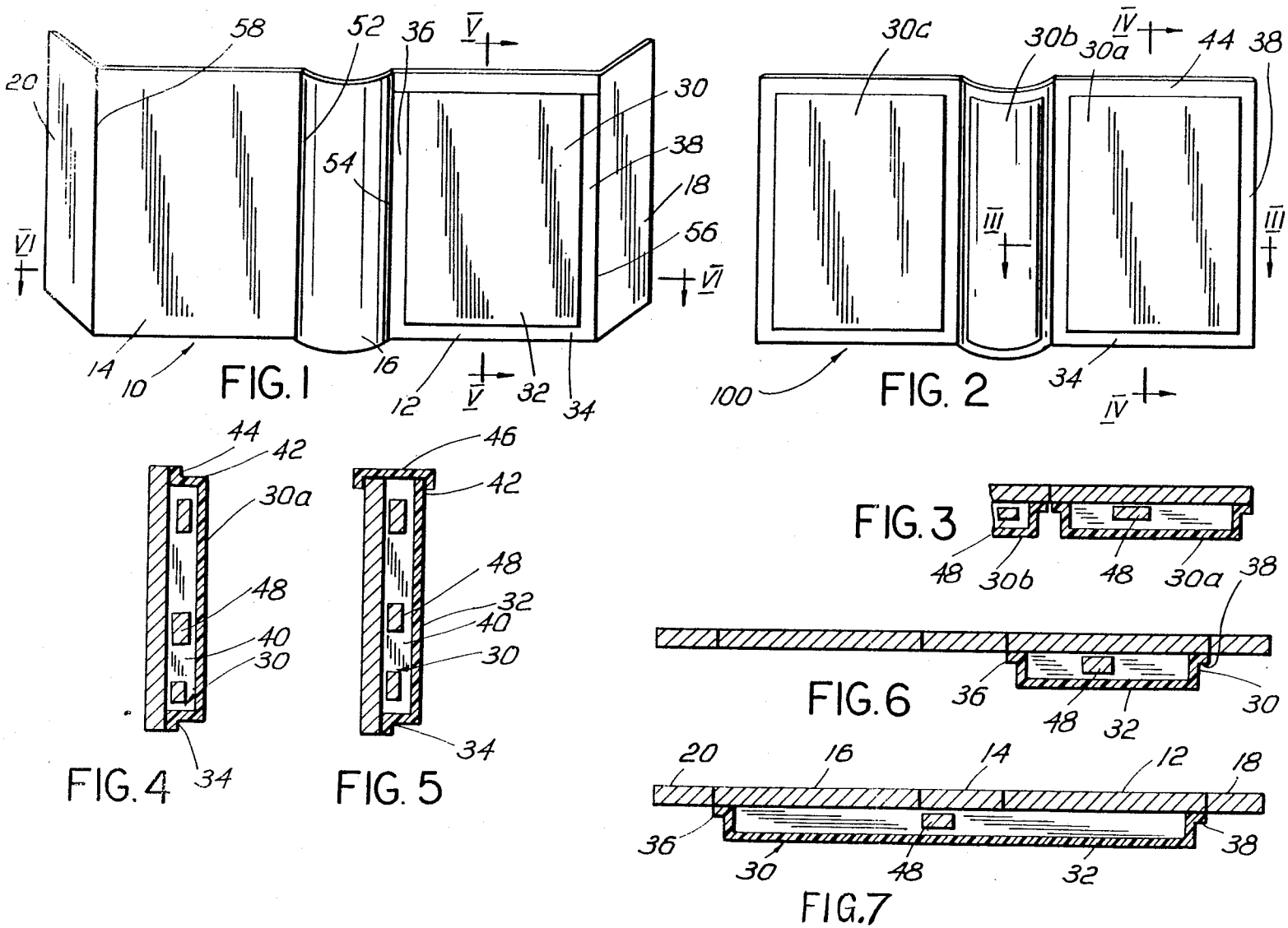
FIG. 1 is a cover jacket for a book together with a pocket formed on the front member of the jacket in accordance with the invention.
FIG. 2 is a modification of the cover jacket of FIG. 1, but the pocket is formed on the entire exposed surface of the cover jacket; in this embodiment, three pockets are shown and the cover jacket is shown as a cover for a book forming an integral part of the book with the flaps omitted.
FIG. 3 is a section taken on line 3—3 of FIG. 2.
FIG. 4 is a section taken on line 4—4 of FIG. 1.
FIG. 5 is a section taken on line 5—5 of FIG. 1.
FIG. 6 is a section taken on line 6—6 of FIG. 1.
FIG. 7 is a view similar to FIGS. 3 and 6 but showing another embodiment of my invention with a single pocket extending across the cover jacket covering more than a front or rear portion of the book.

In all embodiments of the invention, the material to be inserted into the pocket has been shown schematically for the sake of clarity, and it has been shown as an indicia for identification purposes. It is to be understood that various different specific materials, both two-dimensional with a very minor thickness, as well as three-dimensional objects having different thicknesses, lengths, and widths can be inserted into the pocket.

DESCRIPTION OF THE PREFERRED EMBODIMENTS

Referring now to the drawing which shows the presently preferred mode of carrying out the invention, a book jacket 10 of the conventional type generally has a front member 12, a rear member 14, a spine or center connecting portion 16, a front flap 18 which can be turned in onto the inside of a front cover of a book (not shown), and a rear cover flap 20 which can be turned in onto the inside of a rear cover of the book. This describes a generally conventional book jacket which can be formed of an opaque material or a see-through plastic material or equivalent.

In FIG. 2, there is shown a cover 100 which generally forms an integral part of the outer cover covering the pages of the book. In this embodiment, flaps 18 and 20 shown in FIG. 1 are omitted, and it should be known that any selvedge edges which would be used have been omitted for the purpose of clarity.

In accordance with the one preferred embodiment of the invention, it is proposed to include a pocket or enclosure 30, preferably forming part of the front cover 12. For this purpose, I prefer to use a cover formed of heat-sealable material, such as a heat-sealable plastic which may be opaque or of the see-through type, and an outer pocket member 32 which is heat-sealed at junctures 34, 36 and 38 with front cover 18 to form inner pocket area 40.

While it is preferred that outer pocket member 32 be transparent, for purposes of the invention, different unique and artistic effects are obtainable using translucent materials. Of course, if a hidden pocket is desired, it may be formed from an opaque material.

In FIG. 2, which shows cover 100, pocket or enclosure 30 is shown as three individual pockets **30*a*, 30*b* and 30*c*. Each of the pockets is sealed at 34, 36 and 38, in a manner similar to the sealing in FIG. 1**.

Pocket 40 and pocket member 32 as shown in FIGS. 2 and 4 may be closed at its top at 42 by a heat seal 44 to seal and to provide a complete non-entry type of closure. All pockets may, in accordance with this invention, be sealed in this manner.

Pocket 40, as best seen in FIGS. 1, and 5 may also be closed at the top by means of a sealing tape 46 so as to permit repeated entry to pocket 40 if desired. When the jacket cover 10 is used as an addition to a cover for a book, then either a heat seal such as 44 in FIG. 2 may be used or a sealing tape 46 may be used for repeated access.

Pocket 40 may be filled with different pre-selected types of filler material, schematically indicated as 48, which can produce an appropriate unique and aesthetic effect. Pocket filler material 48 is shown as an example and may be two-dimensional or three-dimensional as heretofore defined.

With respect to cover jacket 10, once the cover jacket is being made with a pocket 40, it can also be manufactured by taking a flat plastic material and scoring the material along lines 52 and 54 to form center connecting portion 16 and front and rear panels 12, 14 respectively. Flaps 18 and 20 may also be formed by score lines 56, 58 for connection and movement thereof relative to front and rear members 18, 20, respectively.

In FIG. 2, the members 12, 14 and 16 are shown without flaps 18, 20 because cover 100 generally forms a permanent part of the book and, as such, is preferably not removed.

FIG. 7 shows another embodiment in which pocket 30 extends across front 12, rear 14 and spine members 16 to form one large pocket with the intermediate heat seal lines omitted. It is also evident that it is within the scope of this invention to have pocket 30 cover a portion of the front, rear and spine members or extend across the rear and spine members, or the spine and front members.

While there has been shown what is considered to be the presently preferred mode for carrying out the invention, various changes and modifications may be made therein without departing from the scope of the invention.

What is claimed is:

1. A cover jacket for a book having a pocket for receiving and containing an object to create a visual impression, comprising:

a jacket member including a front member to form a front piece for a book cover, and a rear member to form a back piece for the book cover;

means joining said front and said rear members; and pocket means including a pocket element positioned on said jacket member for forming said pocket for receiving said object to create the visual impression and means joining said pocket element to said jacket member and closing said pocket after said object has been inserted thereinto to prevent egress of said object.

2. The cover jacket according to claim 1, wherein said pocket with said object therein is closed on all sides and the object is held within said pocket and on said front member of said jacket member.

3. The cover jacket according to claim 1, wherein said joining means includes a heat seal joining said pocket element to said jacket member with said object sealed between said pocket member and said pocket element.

4. The cover jacket according to claim 1, wherein said joining means includes a heat seal means joining all sides of said pocket to said jacket member together with said object in said pocket.

5. The cover jacket according to claim 1, wherein said joining means includes heat seal means and tape means for closing said pocket means and joining said pocket together with said object therein to said jacket.

6. The cover jacket according to claim 1, wherein said pocket includes a plurality of sides, said joining means includes heat seal means joining all sides of said pocket except at least one side of said pocket to said jacket member and a tape joining said at least one side to said jacket member.

7. The cover jacket according to claim 1, wherein said pocket element is on said front member, and said joining means includes heat seal means to heat seal and join said pocket means to said front member.

8. The cover jacket according to claim 1, wherein said pocket element is on said front member, and said joining means includes a tape means to join one of the sides of said pocket element to said front member and heat seal means joining the remainder of the sides of said pocket element to said front member.

9. The cover jacket according to claim 1, wherein said pocket element is translucent.

10. The cover jacket according to claim 1, wherein said jacket member and said pocket means is transparent.

11. The cover jacket according to claim 1, including first and second flap means connected respectively with said front and rear members, to form a removable cover for a book.

12. A cover jacket for a book to create a three-dimensional effect on at least a portion of said cover jacket, comprising:

a jacket member including a front member to form a front piece for a book cover, a rear member to form a back piece for the book cover, and a spine member for joining said front and rear members; and a pocket-forming member having a plurality of sides overlying at least one of said front members, said rear member or said spine member;

at least one three-dimensional object sandwiched between said pocket-forming member and said at least one of said front, rear or spine members; and means sealing at least one side of said pocket-forming member to said at least one of said front, rear or spine members, and heat sealing means for sealing the remaining sides of said pocket forming member to said at least one of said front, rear or spine members with said at least one three-dimensional member enclosed between said pocket-forming member and said at least one of said front, rear or spine member to present a visual three-dimensional effect on at least one of said front, rear or spine members.

* * * * *